US005365260A

United States Patent [19]

Kitani et al.

[11] Patent Number: 5,365,260

[45] Date of Patent: Nov. 15, 1994

[54] INK SUPPLY DEVICE WITH ELASTIC VALVE FOR LIQUID SUPPLYING SLIT

[75] Inventors: Masashi Kitani, Yokohama; Yoshifumi Hattori, Yamato; Etsurou Suzuki, Yokohama; Hideo Saikawa, Kawasaki; Masami Kojima; Kenji Kawano, both of Tokyo; Koichi Tanno, Kawasaki; Kenji Aono, Kawasaki, all of Japan

[73] Assignee: Canon Kabushiki Kaisha, Tokyo, Japan

[21] Appl. No.: 900,013

[22] Filed: Jun. 17, 1992

[30] Foreign Application Priority Data

Jun. 19, 1991 [JP] Japan ..... 3-147394
Jun. 19, 1991 [JP] Japan ..... 3-147401

[51] Int. Cl.[5] ..... B41J 2/175

[52] U.S. Cl. ..... 347/87; 222/96; 222/213; 347/94

[58] Field of Search ..... 346/140 R, 75, 1.1; 222/95, 96, 212, 213

[56] References Cited

U.S. PATENT DOCUMENTS

| | | | |
|---|---|---|---|
| 4,313,124 | 1/1992 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,475,116 | 10/1984 | Sicking et al. | 346/140 R |
| 4,500,895 | 2/1985 | Buck et al. | 346/140 R |
| 4,509,062 | 4/1985 | Low et al. | 346/140 R |
| 4,514,742 | 4/1985 | Suga et al. | 346/140 R |
| 4,558,333 | 12/1985 | Sugitani et al. | 346/140 R |
| 4,677,447 | 6/1987 | Nielsen | 346/140 R |
| 4,723,129 | 2/1988 | Endo et al. | 346/1.1 |
| 4,740,796 | 4/1988 | Endo et al. | 346/1.1 |
| 4,771,295 | 9/1988 | Baker et al. | 346/1.1 |
| 4,785,314 | 11/1988 | Terasawa et al. | 346/140 R |

FOREIGN PATENT DOCUMENTS

| | | |
|---|---|---|
| 0496620 | 7/1992 | European Pat. Off. . |
| 59-098857 | 6/1984 | Japan . |
| 59-123670 | 7/1984 | Japan . |
| 59-138461 | 8/1984 | Japan . |
| 63-087242 | 4/1988 | Japan . |
| 2258353 | 10/1990 | Japan . |

*Primary Examiner*—Benjamin R. Fuller
*Assistant Examiner*—John E. Barlow, Jr.
*Attorney, Agent, or Firm*—Fitzpatrick, Cella, Harper & Scinto

[57] ABSTRACT

An ink jet cartridge is composed integrally of a recording head and an ink tank, which are constructed in mutually separable manner, in order to enable repeated use of the recording head by replacement of the ink tank. In an ink supply part in the ink tank, an elastic partition wall is provided with a slit which is normally closed but is opened under a predetermined pressure difference. The slit is so designed as to generate an appropriate negative pressure on the recording head, thereby preventing ink leakage. Also a slit shielding valve member is provided to shield the slit at the abrupt inhaling action of the ink tank at the detaching of the ink tank, in order to prevent air intrusion into the ink tank.

23 Claims, 15 Drawing Sheets

INK SUPPLY DEVICE WITH ELASTIC VALVE FOR LIQUID SUPPLYING SLIT

BACKGROUND OF THE INVENTION

1. Field of the Invention

The present invention relates to an ink tank equipped with a negative pressure regulating mechanism, an ink jet cartridge composed of said tank and a recording head for ink discharge connected to said tank, and an ink jet recording apparatus in which said cartridge is detachably mounted.

2. Related Background Art

For facilitating the ink replenishment in the conventional ink jet recording apparatus, particularly ink jet printers, there has been proposed an ink jet cassette of cartridge type, or an ink jet cartridge which integrally includes a recording head and an ink tank and is interchangeably constructed.

As an example, FIG. 9 illustrates an ink jet recording apparatus of ink cassette type, with a fixed ink tank, wherein shown are an ink cassette 800, an ink supply tube 850, and a pump 20. In this case, a recording head 10 is mounted in the main body of the printer and is connected by a tube or the like to an ink supply part of the ink tank, and a separate ink cassette is placed by the operator in a predetermined position in said main body, whereby the ink cassette and an ink tank connector are coupled to enable the ink supply. However, since the ink cassette itself is not provided with a negative pressure, if the recording head 10 is placed at a same height as the ink cassette, the head pressure of the ink cassette is applied to the nozzles of the recording head 10, thus eventually causing ink leakage from said nozzles. Therefore, in such ink cassette system, the negative pressure to the recording head 10 is generated by the head relative thereto, namely by positioning the ink cassette by a required positional head pressure H below the recording head 10. However, in such conventional ink cassette system, in which the recording head and the ink cassette are connected by a tube, the printer main body is difficult to compactize as there are required spaces for installing the ink cassette and connecting tube. Also in case the recording head and the ink cassette are connected by a tube, the printing speed is difficult to improve as the ink has to be brought to the recording head from the ink cassette through the tube, by means of the capillary action of the nozzles of said recording head. The ink cassette, if attached to the side of the recording head, will eliminate the space required for the connecting tube and enable the improvement in the printing speed, but in such arrangement it is difficult to locate the ink cassette and the recording head side by side since the negative pressure is generated by the positional head pressure at the height of the ink cassette to the recording head and the ink cassette itself has no negative pressure.

On the other hand, for ink storage in the ink jet cartridge integrally containing a recording head and an ink tank, there is already known a method of impregnating a porous member with ink, as disclosed in U.S. Pat. No. 4,771,295 corresponding to Japanese Patent Laid-Open Application No. 63-87242.

However, such method is unsatisfactory in volume efficiency since the ink is impregnated in a porous member such as sponge, and an increase in the tank capacity is difficult to attain since the negative pressure increases with the decrease of ink in the tank, thus leaving a certain unusable amount of ink therein.

For improving the volume efficiency there is preferred direct storage of ink in the container, and, for such purpose, there is known a method of storing ink in a rubber bladder, as disclosed in U.S. Pat. No. 4,509,062 corresponding to Japanese Patent Laid-Open Application No. 59-98857.

However, such method is still unsuitable for increasing in tank capacity, as it is associated with a drawback of fluctuation of pressure to the recording head, resulting from ink vibration in the tank caused for example by the carriage movement. Also there is a drawback that a considerable amount of unusable ink remains in the tank, as the negative pressure maintained by the rubber bladder increases with the decrease of ink therein.

In order to resolve these drawbacks, the present inventors proposed pressure regulation means which is very simple in structure and has also a valve function capable of stable supply and shut-off of liquid. More specifically, pressure regulation means having valve function and consisting of an elastic member with a slit which is closed in the normal state but is opened at a certain pressure difference is provided in the ink tank, thereby enabling ink supply to the recording head with the liquid pressure on the nozzles controlled within a predetermined range. More precisely, there is provided, in the ink tank or in the ink path, a partition wall of an elastic material with valve function (hereinafter called slit bladder) which is deformed to open the slit when the difference between the internal and external pressures is at least equal to a predetermined value, but assumes the original state to close the slit when the pressure difference is lower than a certain value.

Such configuration has enabled stable ink discharge with an ink tank of a large capacity. The use of such ink tank of large capacity is preferable in attaining the advantages such as reduced running cost, in the configuration employing separated recording head and ink tank. Particularly the use of the slit bladder has enabled to increase the ratio of stored ink amount to the ink tank, and to store a large amount of ink in a compact ink tank. This fact has realized a configuration in which the recording head and the ink tank are integrally constructed in the printer, and has provided a simpler and less expensive ink tank, in comparison with the conventional separated configuration in which the ink tank is fixed in the interior of the main body of the printer and is connected to the recording head through a tube.

However, in the configuration with the separated ink tank, the pressure of the recording head can never be always same as that of the ink tank at the attaching or detaching operation thereof, so that the ink always flows to the lower pressure side through the connecting tube therebetween. Air eventually present in said tube may enter the ink tank, and such air in the ink tank may be introduced into the recording head through the connecting tube and to the nozzles of said recording head, thus resulting in failure in the ink discharge from the nozzles.

Also if the recording head contains air in a state with zero or a slight negative pressure, said air may be inhaled rapidly by the pressure in the slit bladder and may intrude into the ink bag, constituting the main ink container of the ink tank through the slit bladder. Such air intrusion into the ink bag may cause ink leakage from the nozzles for example when the bag is pressurized by air expansion under a change in the atmospheric conditions such as a high temperature.

Though the air intruding into the recording head can be eliminated by a recovery pump provided in the printer itself, but the air intruding into the ink bag of the main tank through the slit bladder is difficult to remove as it tends to stick to the bag or to be blocked by the slit bladder. Such ink intrusion has therefore to be securely prevented.

Besides, the integral ink jet cartridge including the recording head and the ink tank is desired to be free from ink leakage and to provide satisfactory print quality in the horizontal or vertical position, in order that a same cartridge can be used in different models of printer. For this reason the range of negative pressure permissible in the ink tank becomes narrower, so that effective utilization of ink cannot be attained. In addition, if the ink tank capacity is diversified, a recording head has to be prepared matching each ink tank.

Furthermore, for compactizing the printer itself, it is desired to further compactize the ink jet cartridge. However, the ink jet cartridge integrally including the ink tank, if compactized, leads to an increase in the running cost since the recording head becomes unusable when the ink runs out, and the level of compactization has not yet been satisfactory.

SUMMARY OF THE INVENTION

In consideration of the foregoing, a first object of the present invention is to provide means capable of shielding the slit, for preventing intrusion of air from the slit, in a stable manner with a very simple structure.

A second object of the present invention is to provide an ink jet cartridge capable of providing various print modes with satisfactory print quality, and an ink jet recording apparatus capable of mounting such ink jet cartridge.

The above-mentioned first object can be attained, according to the present invention, by an ink tank provided with an ink supply unit for storing and supply ink, wherein said ink supply unit is provided with a partition wall composed of an elastic material with a slit which is normally closed but is opened by a predetermined pressure difference, and there is provided, in an area between said partition wall and said ink supply unit, shield means capable of shielding said slit in response to a pressure change in said area.

Also there is provided an ink jet cartridge composed integrally of recording means capable of ink discharge and an ink tank containing ink to be supplied to said recording means, and adapted to be detachably mounted on an ink jet recording apparatus capable of image recording by forming ink dots on a recording material, wherein said recording means and said ink tank of the cartridge are constructed separably, an ink supply unit in said ink tank is provided with a partition wall composed of an elastic material with a slit which is normally closed but is opened by a predetermined pressure difference, and there is provided, in an area between said partition wall and said ink supply unit, shield means capable of shielding said slit in response to a pressure change in said area.

Furthermore there is provided an ink jet recording apparatus equipped with a support member for mounting and supporting an ink jet cartridge composed integrally of recording means capable of ink discharge and an ink tank containing ink to be supplied to said recording means, and means for transporting a recording material on which desired recording is formed by the ink discharged from said cartridge, wherein said recording means and said ink tank of the cartridge are constructed separably, an ink supply unit in said ink tank is provided with a partition wall composed of an elastic material with a slit which is normally closed but is opened by a predetermined pressure difference, and there is provided, in an area between said partition wall and said ink supply unit, shield means capable of shielding said slit in response to a pressure change in said area.

As explained above, slit shielding means capable of shielding a slit, constituting the pressure regulation means, at a controlled pressure or above but not influencing the function of said pressure regulation means below said controlled pressure, is provided in an area between an ink supply unit in the ink tank and a slit bladder, thereby preventing the intrusion of air through said slit bladder and preventing the intrusion of air, eventually passing through the slit bladder, into the ink bag.

Also the foregoing second object can be attained, according to the present invention, by an ink cartridge composed integrally of recording means capable of ink discharge and an ink tank storing ink to be supplied to said recording means, and adapted to be detachably mounted on an ink jet recording apparatus capable of recording a character or an image by forming ink dots on a recording material, wherein said recording means and ink tank of the cartridge are constructed separably, an ink supply unit in said ink tank being provided with a partition wall composed of an elastic member with a slit which is normally closed but is opened by a predetermined pressure difference, and said partition wall being provided with an elastic modulus, a curvature and a thickness selected according to the capacity and external dimension of said ink tank and the mode use of said cartridge.

Furthermore there is provided an ink jet recording apparatus for recording a character or an image by forming ink dots on a recording material, comprising a support member for detachably mounting and supporting an ink jet cartridge and means for transporting the recording material on which a desired recording is to be formed by the ink discharged from said cartridge, wherein said cartridge is composed integrally of recording means capable of ink discharge and an ink tank containing ink to be supplied to said recording means, said recording means and ink tank of the cartridge being constructed separably, an ink supply unit in said ink tank being provided with a partition wall composed of an elastic member with a slit which is normally closed but is opened by a predetermined pressure difference, and said partition wall being provided with an elastic modulus, a curvature and a thickness selected according to the capacity and external dimension of said ink tank and the mode of use of said cartridge.

By constructing the recording head and the ink tank in mutually separable manner and providing a predetermined position of the ink tank with a partition wall of an elastic material with a slit (hereinafter called slit bladder), there can be obtained a cartridge that can adapt to various capacities of ink tank and various printing modes of recording head, by simply replacing the ink tank while employing a same recording head.

DETAILED DESCRIPTION OF THE PREFERRED EMBODIMENTS

Embodiment 1

Figure 1A:
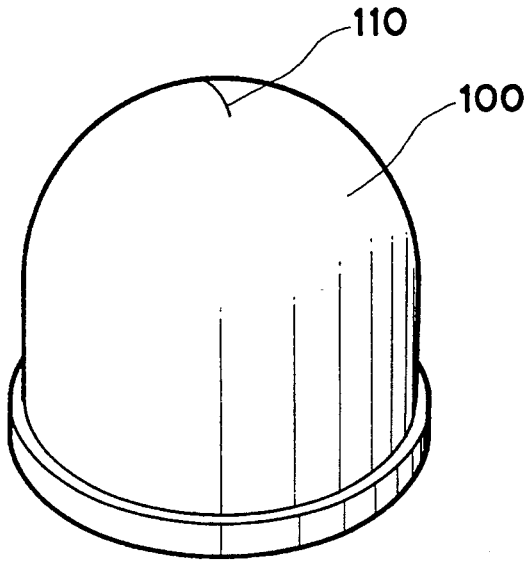
FIGS. 1A and 1B are views showing a slit bladder and a slit shield valve in a first embodiment of the present invention.
Figure 1B:
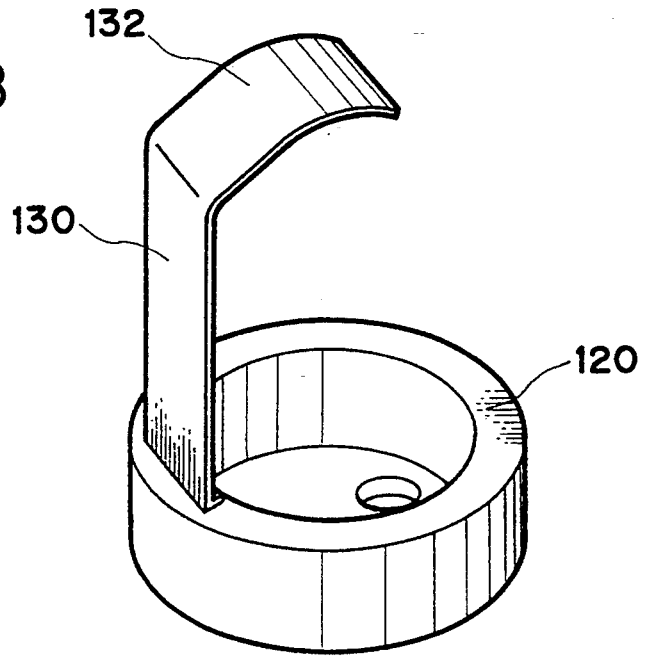
Figure 2:
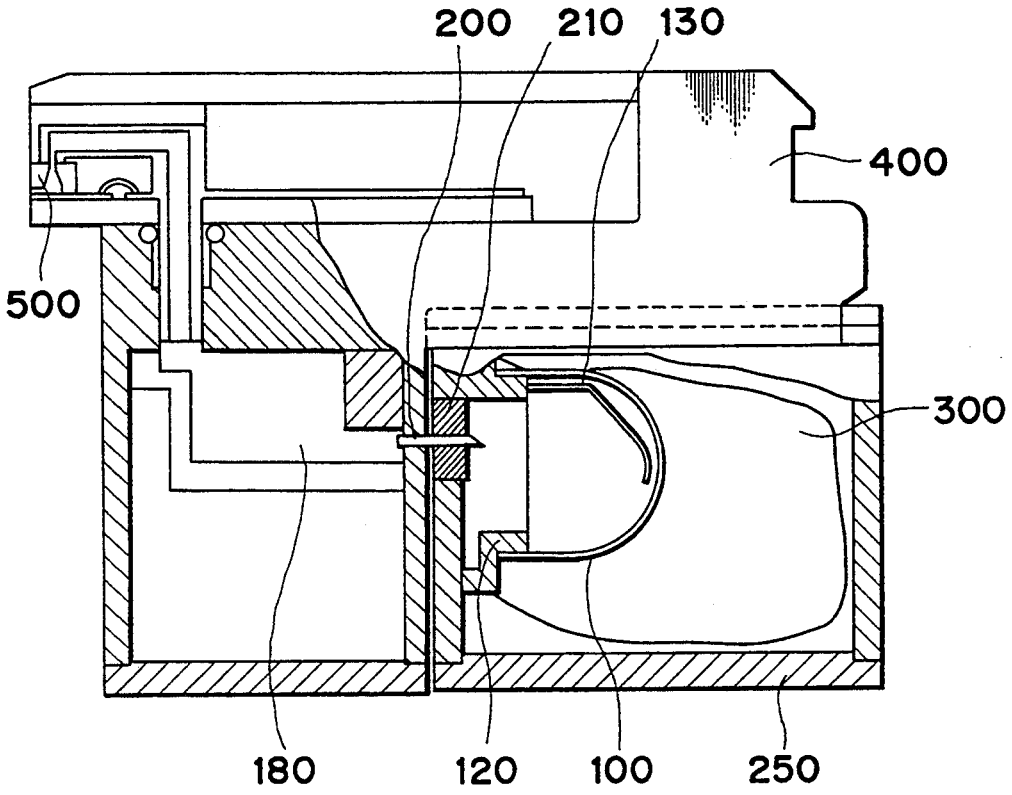
FIG. 2 is a cross-sectional view of an ink cartridge including an ink tank with a slit shield valve of the first embodiment of the present invention, shown in a state with the slit closed.

Now the present invention will be clarified in detail by embodiments thereof shown in the attached drawings. FIGS. 1A to 2 show a first embodiment of the slit bladder of the present invention, and FIGS. 1A and 1B illustrate a slit bladder to be mounted on the ink tank of the present invention, a mounting member therefor and a slit shield valve. FIG. 2 shows an ink jet cartridge composed of a recording head and an ink tank in separate structure and including a slit bladder in said ink tank.

Referring to FIGS. 1A, and 2 to 4, a slit bladder 100 is composed of an elastic material with a hardness of 15°–70° (JISA), preferably 25°–50°. Preferred examples of said elastic material include silicione rubber, SBR, BRIR, EPM, EPDM, butyl rubber, chloroprene rubber, urethane rubber, fluorinated rubber, nitrile rubber, acrylic rubber, polysulfurized rubber, ethylene rubber, fluorosilicone rubber, and SEP rubber (silicone-denatured ethylene-propylene rubber).

These materials, being maintained in contact with ink in the ink tank, should be free from substances that influence the physical properties (surface tension, viscosity etc.) of the ink or are dissolved into the ink. At the same time, these materials should be free from variations in their physical properties by the ink.

There are also shown a slit or cutout 110, and a mounting member 120 for the slit bladder. Said mounting member has a form matching the external peripheral form of the base portion of the bladder, and is oval in the present embodiment.

On the upper face of the bladder mounting base portion of said mounting member 120, there is provided an elastic slit closing shield valve 130, which prevents intrusion into the ink bag, of air entering when the ink tank is detached from the recording head.

More specifically, if the pressure of an ink tank 250 is lower than that of a recording head 500, when the ink tank 250 is attached, the air and ink in the recording head 500 are inhaled through a connecting tube 200 connecting said recording head 500 and ink tank 250, in such a direction as to rapidly decrease the pressure inside a slit bladder 100. In such state, because of the inhaling force, the slit bladder 100 deforms to an expanded state beyond the original state. As a result, air and ink may intrude into an ink bag 300, constituting the main ink reservoir of the ink tank 250, through the slit 110 at the end of the slit bladder 100. At this point, however, the end portion 132 of the slit shield valve 130 moves toward the slit 110 under the inhaling pressure of the ink and air, thereby covering the slit 110. Consequently, even if air is supplied to the slit, it cannot enter the ink bag through said slit 110.

When the pressure of the recording head 500 is subsequently balanced with that of the ink tank 250, the end portion 312 of the slit shield valve 130 returns to the original position, thereby not affecting the ordinary valve function of the slit 110.

In the present embodiment, the slit 110 of the slit bladder 100 and the end portion 132 of the slit shield valve 130 are mutually spaced, in the normal state, by a gap of 0.5 mm.

The positive pressure required for the silt shield valve 130 to shield the slit 110 is preferably 0 mm water head or higher, more preferably +30 mm water head or higher.

In the present embodiment, said slit shield valve 130 is composed of an elastic material, which is advantageously composed, for example, of silicone rubber, SBR, BRIR, EPM, EPDM, butyl rubber, chloroprene rubber, urethane rubber, fluorinated rubber, nitrile rubber, acrylic rubber, polysulfurized rubber or ethylene rubber. Also similar effects can naturally be obtained by a mechanical valve controlled in one direction.

However these materials, being maintained in contact with the ink in the ink tank, should be free from substances that may vary the physical properties (surface tension, viscosity etc. ) of the ink or may be dissolved in the ink. Also these materials should not cause variations in their physical properties by the ink.

In said slit shield valve 130, the end portion 132 should preferably be thinner than other portions, in order to attain better response. In the present embodiment, the end portion has a thickness of 0.1 mm while other portions have a thickness of 0.3 mm.

The slit bladder 100 is mounted on the mounting member 120 in such a manner than the slit 110 of said bladder 100 is perpendicular to the longer axis of the oval form of said mounting member 120. As a result, the lateral wall of the slit bladder shows a difference in tension, between the directions of longer axis and shorter axis of the oval mounting member 120, whereby the slit can be smoothly opened by the crushing deformation of the bladder. However said angle may be aberrated within a range of 0°-55°.

FIG. 2 shows the ink cartridge of the present embodiment, employing a slit bladder of the present invention. In said ink cartridge, the recording head 500 and the ink tank 250 are rendered mutually detachable, so that the ink tank can be replaced when the ink therein runs out. There are also shown a connecting portion 200 at the recording head side, and a connecting portion 210 at the tank side. A flexible ink bag 300 shrinks with the decrease of ink in the ink tank 250, with the ink discharge from the recording head 500, whereby the pressure in the ink tank 250 is maintained constant. There is also provided a sub tank chamber 180. The ink tank 250 is provided with an opening (not shown) to the atmosphere, in order to suppress unnecessary pressure fluctuation for the ink supply.

In the present embodiment, the slit bladder is contained in the ink tank 250 and is separated from the sub tank chamber 180. There is illustrated a closed state of the slit 110, in which the slit bladder 100 is in a completely restored state shown in FIG. 1A or in a slightly crushed state, thereby applying a liquid pressure not exceeding +30 mm water head to the nozzles of the recording head 500. In this state the ink does not easily leak from the nozzles, because the meniscus maintaining force of the nozzles is balanced with the internal pressure of the ink tank.

As the ink in the sub tank chamber 180 decreases by the discharge of ink droplets from the recording head, the pressure in the sub tank chamber 180 is lowered and the slit bladder 100 gradually shrinks.

Figure 3:
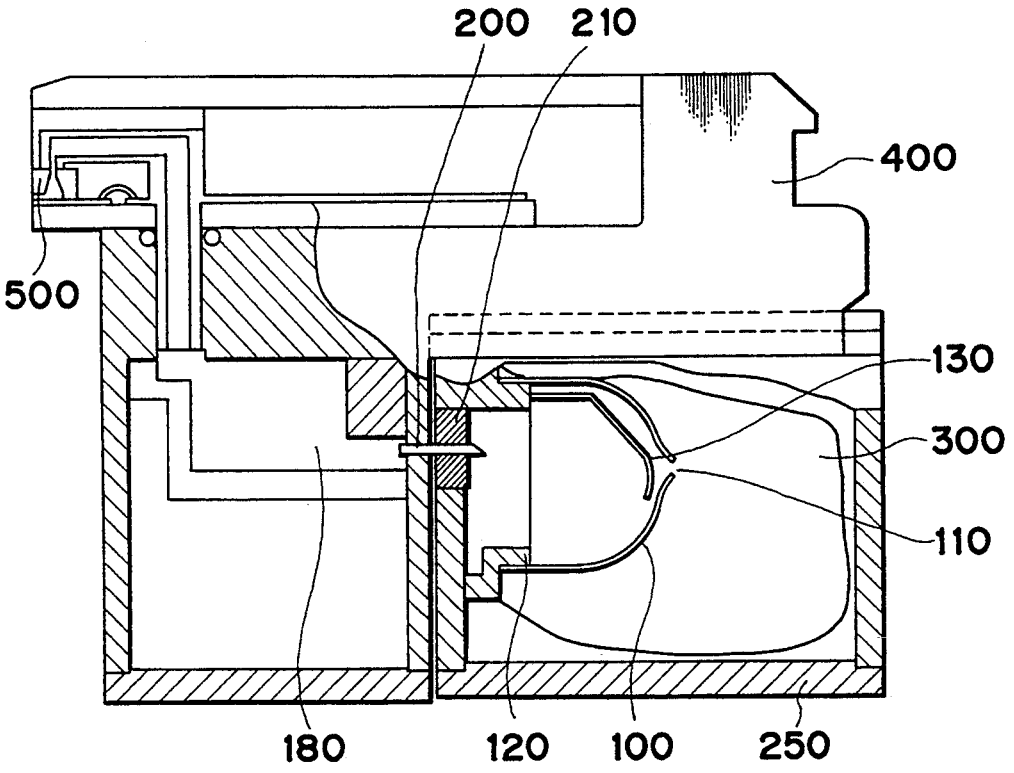
FIG. 3 is a cross-sectional view of an ink cartridge including an ink tank with a slit shield valve of the first embodiment of the present invention, shown in a state with the slit open.

When the difference in the pressure between the sub tank chamber 180 and the ink bag 300 exceeds a certain value in this manner, the slit 110 opens as shown in FIG. 3 by the deformation of the slit bladder 100 itself, whereby the ink flows from the ink bag 300 to the sub tank chamber 180, thereby gradually reducing said pressure difference. With said decrease of pressure difference, the ink flows to the slit bladder 100, whereby the bladder 100 gradually recovers from the crushed state and the slit 110 is closed. In this state the sub tank chamber 180 is in a lower pressure than in the ink bag 300. Consequently the states shown in FIGS. 2 and 3 alternate during the printing operation. In the stationary state, the slit 110 of the slit bladder 100 is closed as shown in FIG. 2. On the other hand, when suction is temporarily applied to the nozzles for example by a suction pump, the slit 110 opens because of the increased pressure difference between the sub tank chamber 180 and the ink bag 300 as in the course of printing operation, and subsequently returns to the stationary state.

In order to obtain ink droplets in stable manner, the ink pressure applied to the recording head 500 is preferably in a range of +30 to −200 mm water head, more preferably in a range of 0 to −100 mm water head, through the pressure control in the sub tank chamber 180. Also the material (hardness) and form of the slit bladder 100 and the form of the slit 110 have to be designed so as to satisfy the above-mentioned conditions.

Figure 4:
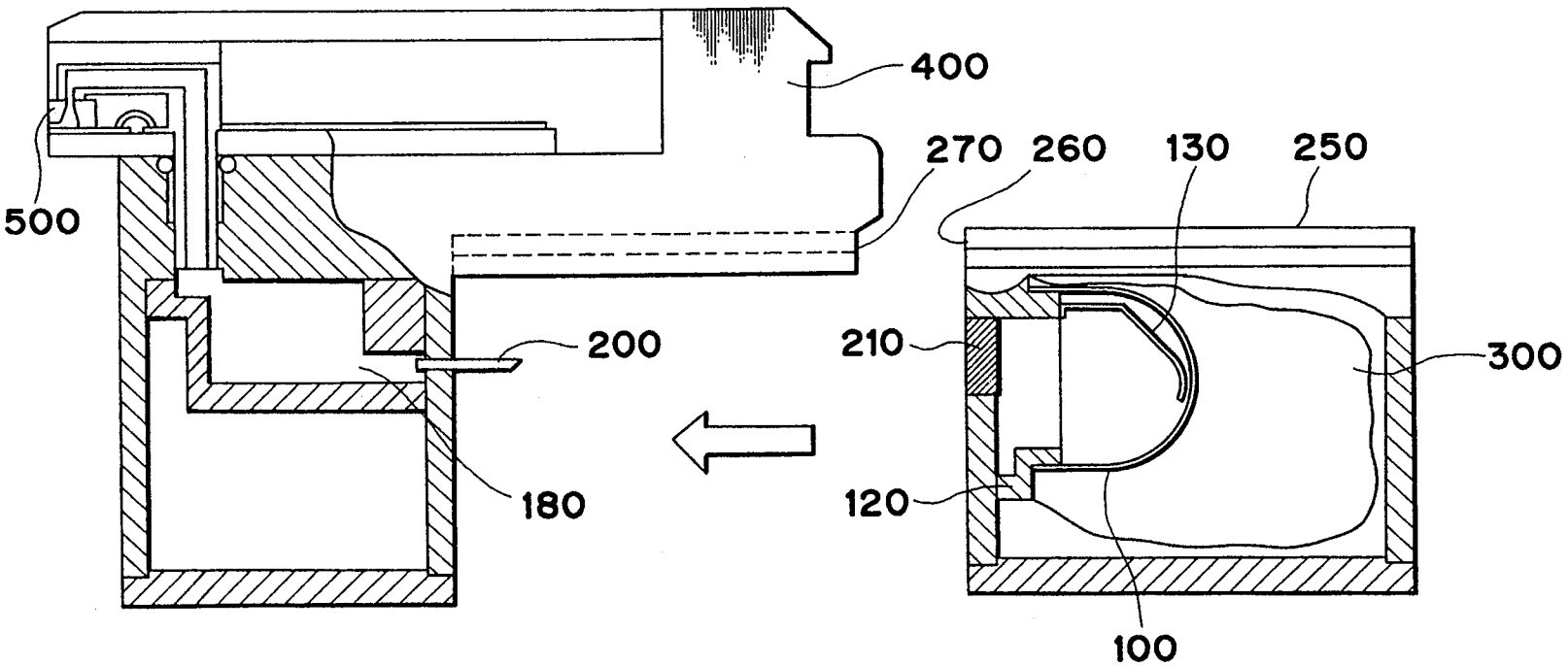
FIG. 4 is a cross-sectional view of an ink cartridge, with a separated ink tank with a slit shield valve of the first embodiment of the present invention, shown in a state with the slit closed.

FIG. 4 shows a state in which the recording head 500 and the ink tank 250 are separated. The ink tank 250 is provided, on a lateral face thereof, with a projection 260 which engages with a groove 270 of the recording head 500, and the communicating state of ink is maintained by mutual engagement to said projection and said groove.

As explained in the foregoing, in a liquid storage tank provided with pressure regulation means composed of an elastic member with a slit which is normally closed but is opened by a predetermined pressure difference, there is provided, either in said tank or in a flow path between said pressure regulation means and a recording head for ink discharge, slit shield means which shields a slit of said pressure regulation means at a predetermined pressure or thereabove but does not affect the function of said pressure regulation means, thereby preventing the intrusion, into the ink bag, of air entering at the attaching or detaching of the ink tank.

As a result, even when the ink tank containing air in the ink bag is left in a high temperature condition, there will not result pressurization by the expansion of air in the ink bag and the ink leakage resulting therefrom, so that the performance of the ink tank holding liquid ink is significantly improved.

In the following there will be explained embodiments in which a recording head is used in connection with various printers or with tanks of different ink capacity.

Embodiment 2

Figure 5:
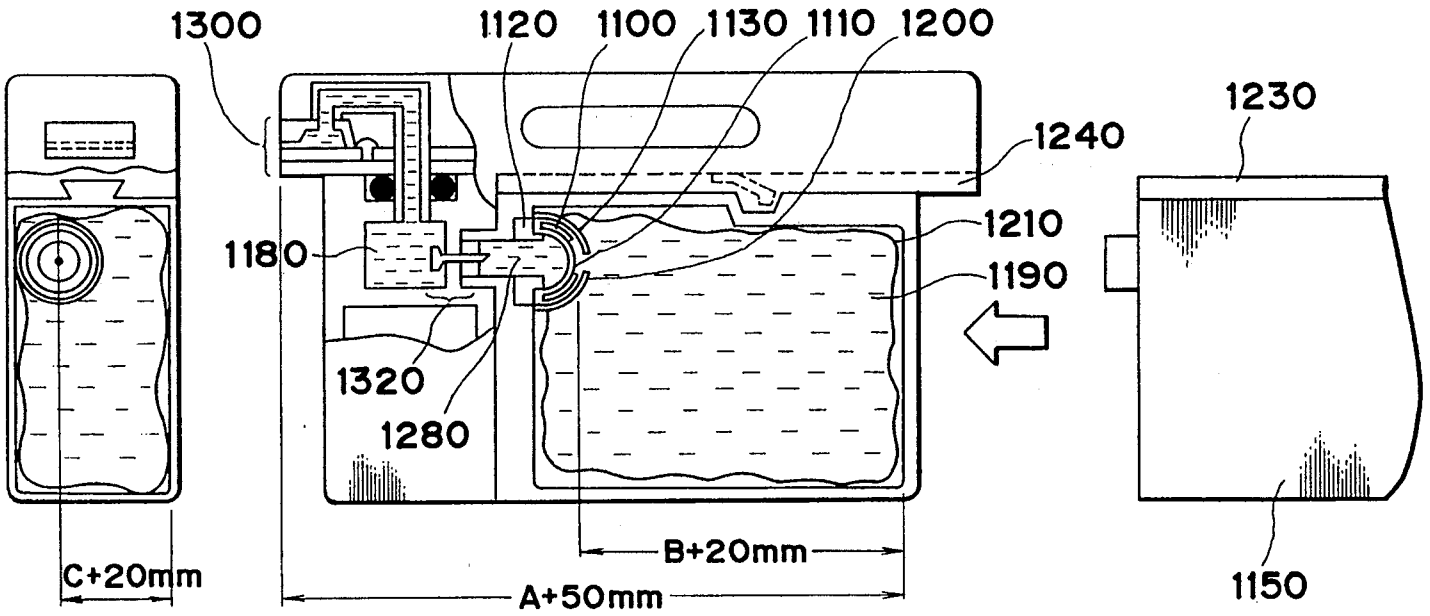
FIG. 5 is a schematic view of an ink jet cartridge with a replaceable small-capacity ink tank incorporating a slit bladder, constituting a second embodiment of the present invention.

FIG. 5 illustrates a second embodiment of the present invention, employing an ink jet cartridge with an ink tank of a small capacity of about 10 cc, wherein the recording head and the ink tank are mutually separably constructed. In FIG. 5 there are shown a slit bladder 1100, a slit 1110, a mounting member 1120, a rib 1130 for defining the shrinking direction, a replacement ink tank 1150, a first ink reservoir 1180 of an extremely small capacity provided on the recording head side, 1 second ink reservoir 1190 consisting of a flexible ink bag at the recording head side, a vibration preventing wall 1200, an ink bag 1210, a guide member 1230 at the ink tank side, a guide member 1240 at the recording head side, an ink path 1280, a recording head 1300, and a connecting part 1320 between the recording head and the ink tank.

In the second ink reservoir there is provided, as shown in FIG. 5, a slit bladder at an ink supply part constituting a junction to the recording head. Printers employing a small-capacity ink jet cartridge are often so designed as to be operable both in the vertical and horizontal positions, so that the ink jet cartridge itself is required to be usable in vertical and horizontal positions, by the designing of the negative pressure of the slit bladder in consideration of the water head of the ink in the ink tank so as not to cause ink leakage and to provide satisfactory printing quality in either of said positions, and by the positioning so as to minimize the remaining ink in the ink tank.

More specifically, the ink pressure applied to the nozzles of the recording head is +50 mm head in the vertical position as shown by (A) in FIG. 5, and +20 mm head in the horizontal position as shown by (C). The pressure applied to the nozzles of the recording head, determined by the difference between the water head of the ink and the negative pressure of the slit bladder, should preferably be a negative pressure in the order of −10 mm head, in order to avoid ink leakage from said nozzles. Therefore, for preventing ink leakage from the nozzles of the recording head, the minimum value of the negative pressure of the slit bladder is selected at about −60 mm head, as the ink pressure applied to the nozzles of the recording head is larger in the vertical position. Also the maximum value is preferably selected as −100 mm head, in consideration of the printing limit of the recording head, namely a limit not causing deterioration in the print quality resulting from the decrease in the water head pressure of the ink in the ink tank, before the ink runs out in the ink tank. Consequently the elastic modulus, curvature and thickness of the slit bladder should be suitably selected in such a manner that the negative pressure of the slit bladder falls within the above-mentioned range of −105±45 mm head.

Figure 10:
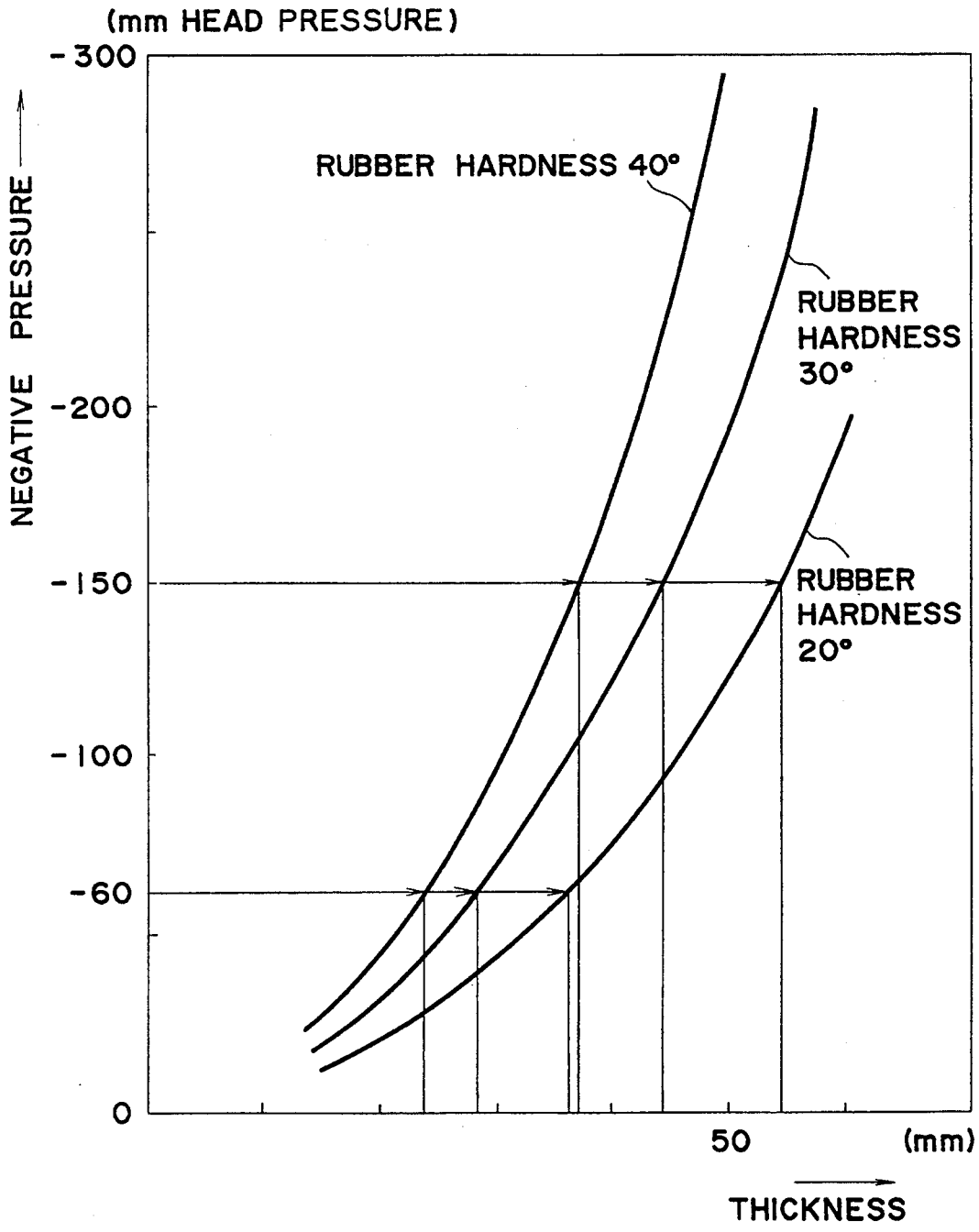
FIG. 10 is a chart showing the relationship between the negative pressure generated by a slit bladder and the thickness thereof.

FIG. 10 shows the relationship between the negative pressure applied by the bladder to the recording head and the thickness of the elastic material constituting the bladder, in various hardnesses represented by JISA. This chart allows to easily determine the thickness range of the slit bladder providing the desired negative pressure range, but said thickness range varies depending on the hardness as the inclination of the curve is variable. Said thickness range should preferably be wider, since the thickness affects the productivity of the slit bladder.

In the present embodiment, with the negative pressure of the slit bladder within a range of −105±45 mm, or from −60 to −150 mm, the thickness of the bladder is from 0.23 to 0.37 mm for a rubber hardness of 40°, from 0.28 to 0.44 mm for a rubber hardness of 30°, and from 0.36 to 0.54 mm for a rubber hardness of 20°.

The ink tank with a tank capacity of 10 cc or less can also be designed for both vertical and horizontal positioning, by selecting the negative pressure of the bladder within the printing pressure range of the recording head in such a manner as not to cause ink leakage by the ink pressure in the ink tank applied to the nozzles of the recording head, when the ink jet cartridge including said recording head and said ink tank is vertically positioned, and by placing the slit bladder in such a position as to minimize the remaining ink in the ink tank. Such an ink jet cartridge with an ink capacity exceeding 10 cc can also be realized to a certain extent by appropriate designing of the negative pressure and the position of the slit bladder, combined with appropriate selection of the form of the ink tank so as to suppress the water head of ink in the ink tank. However, in an ink tank of a small capacity, the proportion of the unusable ink, remaining below the slit of the bladder of the ink tank, will increase unless the size of the slit bladder itself is also made small. Consequently, in designing the negative pressure, it is necessary to at first select the curvature of the slit bladder so as to minimize the size thereof, and then the elastic modulus and the thickness for obtaining the desired negative pressure range.

Embodiment 3

Figure 6:
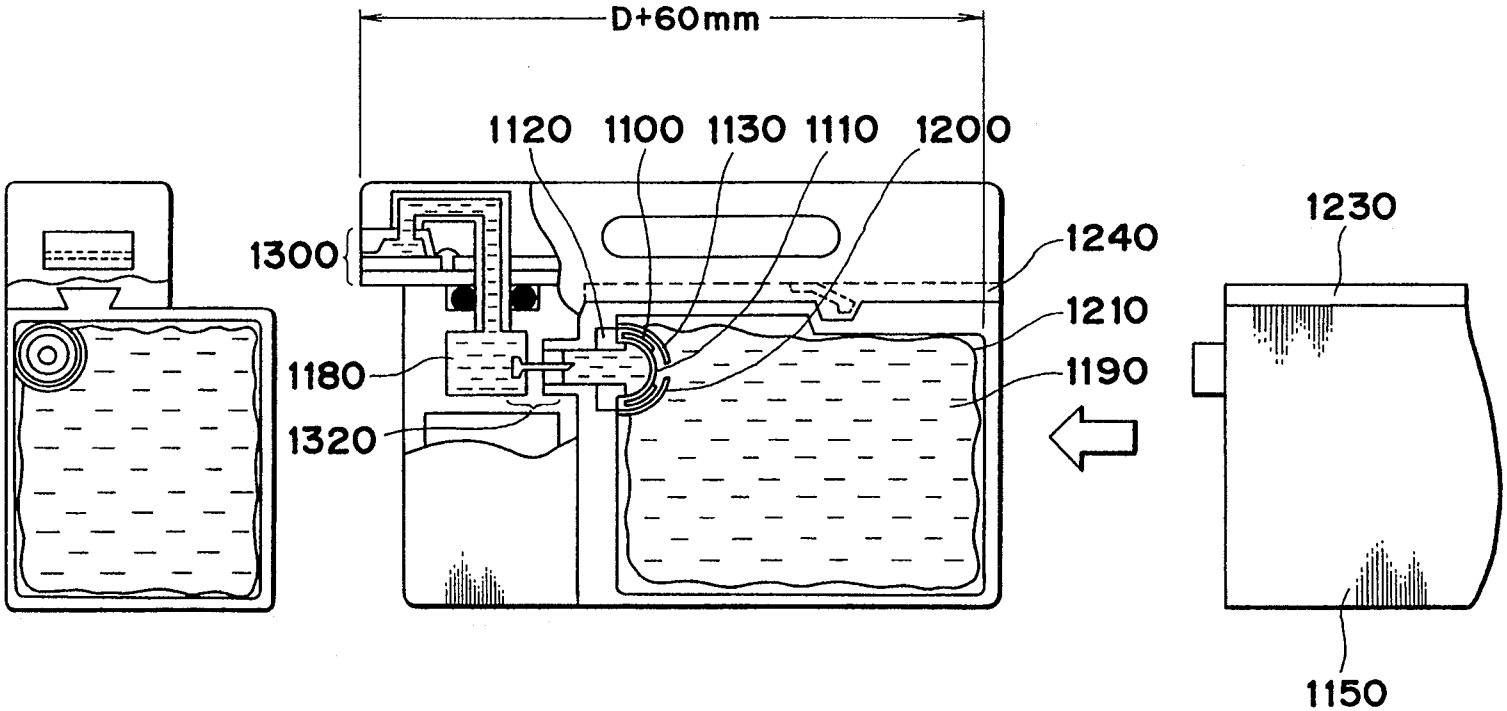
FIG. 6 is a schematic view of an ink jet cartridge of vertical positioning with a replaceable medium-capacity ink tank incorporating a slit bladder, constituting a third embodiment of the present invention.
Figure 7:
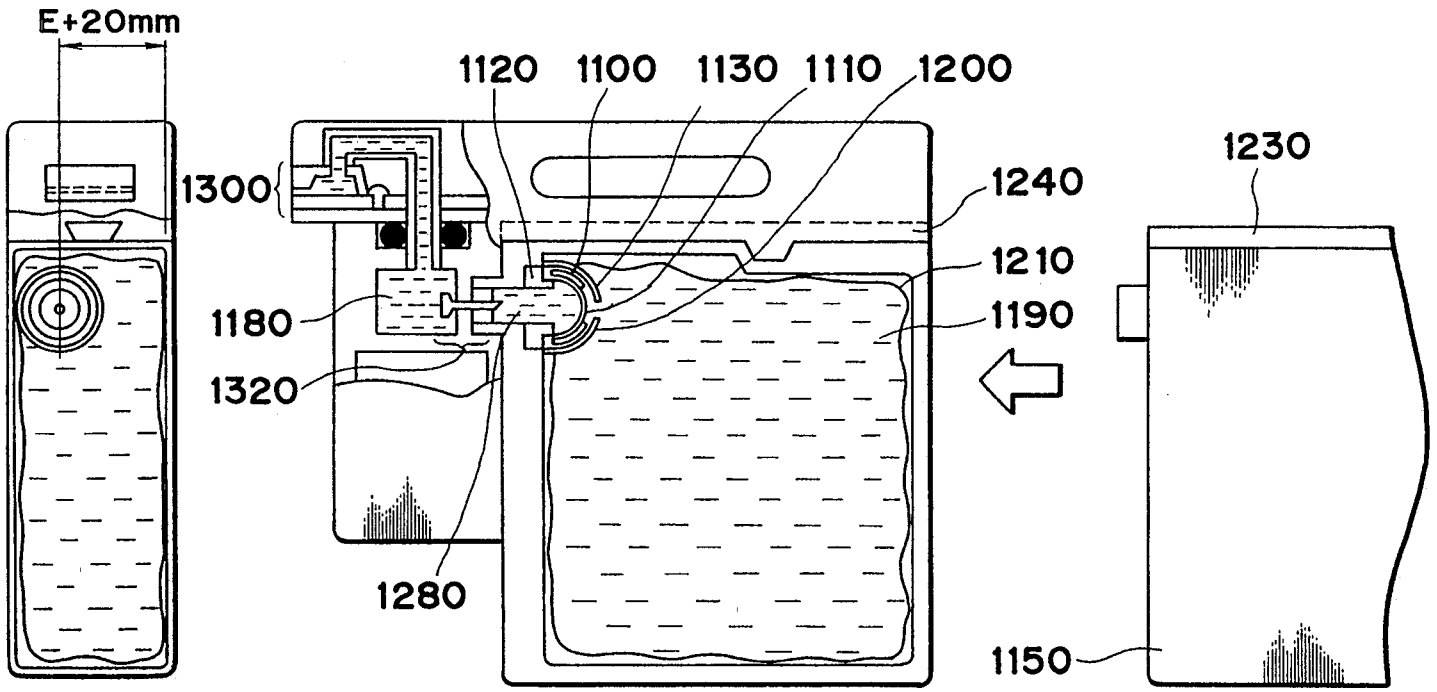
FIG. 7 is a schematic view of an ink jet cartridge of horizontal positioning with a replaceable medium-capacity ink tank incorporating a slit bladder, constituting a third embodiment of the present invention.

FIGS. 6 and 7 illustrate a third embodiment of the present invention, wherein the ink jet cartridge is composed of a recording head and a medium-capacity ink tank of about 40 cc in mutually separate configuration. In FIGS. 6 and 7 there are shown a slit bladder 1100, a slit 1110, a mounting member 1120, a rib 1130 for defining the direction of deformation, a replacement ink tank 1150, a first ink tank 1180, a second ink tank 1190, a vibration preventing wall 1200, a guide member 1230 at the ink tank side, a guide member 1240 at the recording head side, an ink path 1280, a recording head 1300, and a connecting part 1320 between the recording head and the ink tank.

FIG. 6 shows a medium-capacity ink jet cartridge for vertical positioning, with a slit bladder in the illustrated position. In this case the negative pressure of the slit bladder can be designed in consideration of the head of the ink in the ink tank in vertical positioning. More specifically, the head pressure of ink in the ink tank, applied to the nozzles of the recording head in the vertical position, is +60 mm as indicated by D. In order to prevent ink leakage from said nozzles, the pressure applied thereto, which is equal to the difference between the water head pressure of ink and the negative pressure of the slit bladder, should preferably be a negative pressure in the order of −10 mm head. Consequently the minimum value of the negative pressure of the slit bladder is about −70 mm head. The maximum value is preferably −150 mm in consideration of the printing pressure range of the recording head, in order that the print quality is not deteriorated with the decrease of the head of ink in the ink tank, before the ink runs out. Consequently the slit bladder can be so designed as to have the negative pressure in a range of −140±40 mm head, by suitable selection of the elastic modulus, curvature and thickness.

FIG. 7 shows a medium-capacity ink jet cartridge for horizontal positioning, with a slit bladder in the illustrated position. In this case the negative pressure of the slit bladder can be designed in consideration of the head of the ink in the ink tank in horizontal positioning. More specifically, the head pressure of ink in the ink tank, applied to the nozzles of the recording head in the horizontal position, is +20 mm head, as indicated by E. In order to prevent ink leakage from said nozzles, the pressure applied thereto, which is equal to the difference between the water head pressure of ink and the negative pressure of the slit bladder, should preferably be a negative pressure in the order of −10 mm head. Consequently the minimum value of the negative pressure is about −30 mm head. The maximum value is preferably −150 mm in consideration of the printing pressure range of the recording head, in order that the print quality is not deteriorated with the decrease of the head of ink in the ink tank, before the ink therein runs out. Consequently the slit bladder can be so designed as to have the negative pressure in a range of $-90\pm60$ mm head, by suitable selection of the elastic modulus, curvature and thickness.

In the above-explained embodiment, the replacement ink tank of medium capacity for vertical positioning can also be used in the horizontal positioning, but the negative pressure range is narrower in the slit bladder of the medium-capacity replacement ink tank for vertical positioning than in the slit bladder for horizontal positioning. Consequently the cost of the slit bladder can be reduced by designing the negative pressure for matching the replacement ink tank for the horizontal positioning, and the ink tank for horizontal positioning can be provided more inexpensively by differentiating it from the ink tank for vertical positioning. As explained in the foregoing, it is rendered possible to provide the replacement ink tank with an appropriate negative pressure and to provide an excellent cartridge capable of adapting to various apparatus with a single recording head, by constructing the recording head and the replacement ink tank in mutually separable manner and providing the ink tank with the slit bladder with a negative pressure matching the positioning of cartridge at the printing. It is also rendered possible to reduce the cost of the cartridge for each positioning.

Consequently the printer employing a medium-capacity ink jet cartridge as in the present embodiment can be designed for vertical and horizontal positioning, and the cartridge can be used in either position by selecting a corresponding ink tank, so that the recording head can be effectively used in repeated manner.

Embodiment 4

Figure 8:
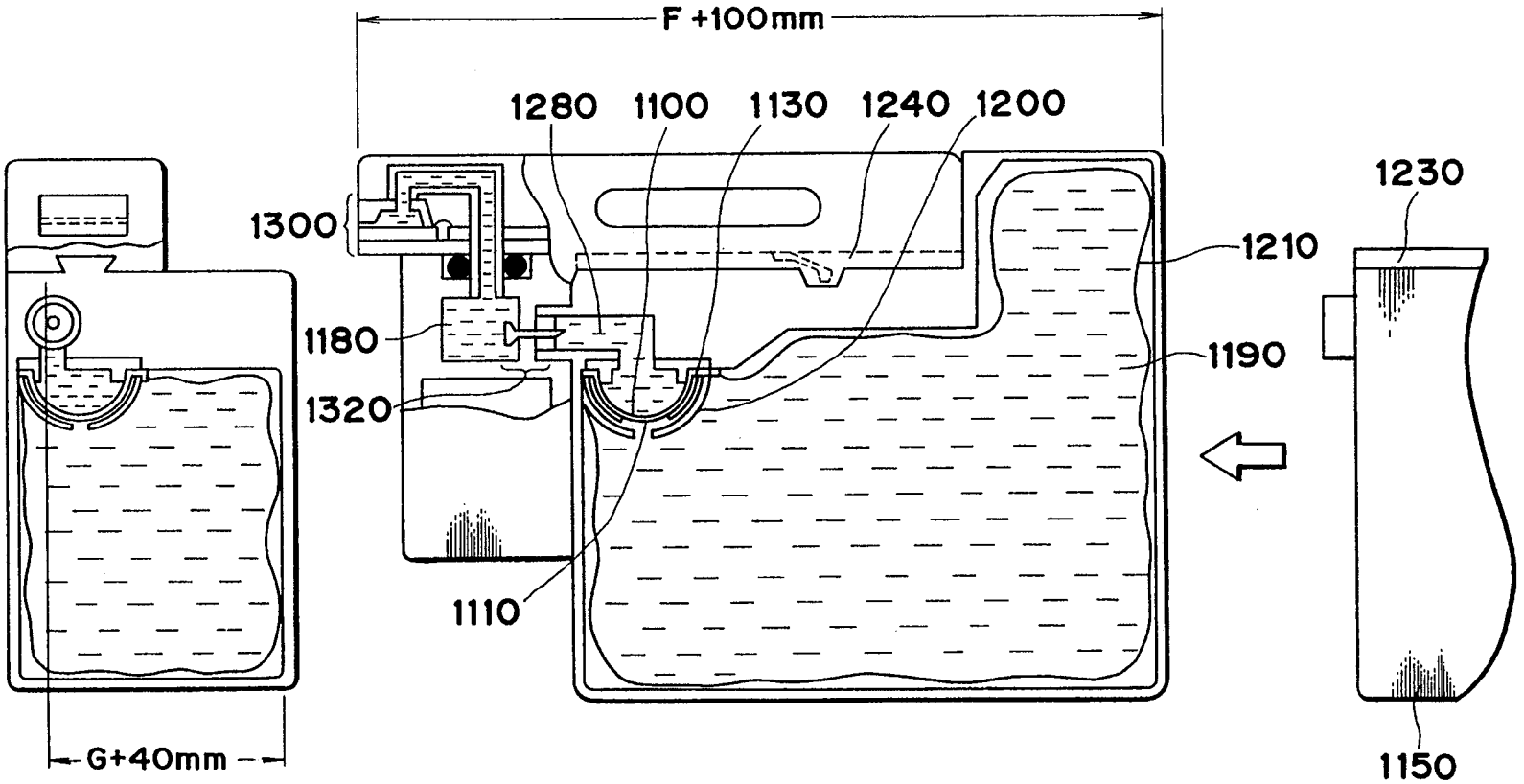
FIG. 8 is a schematic view of an ink jet cartridge with a replaceable large-capacity ink tank incorporating a slit bladder, constituting a fourth embodiment of the present invention.
Figure 9:
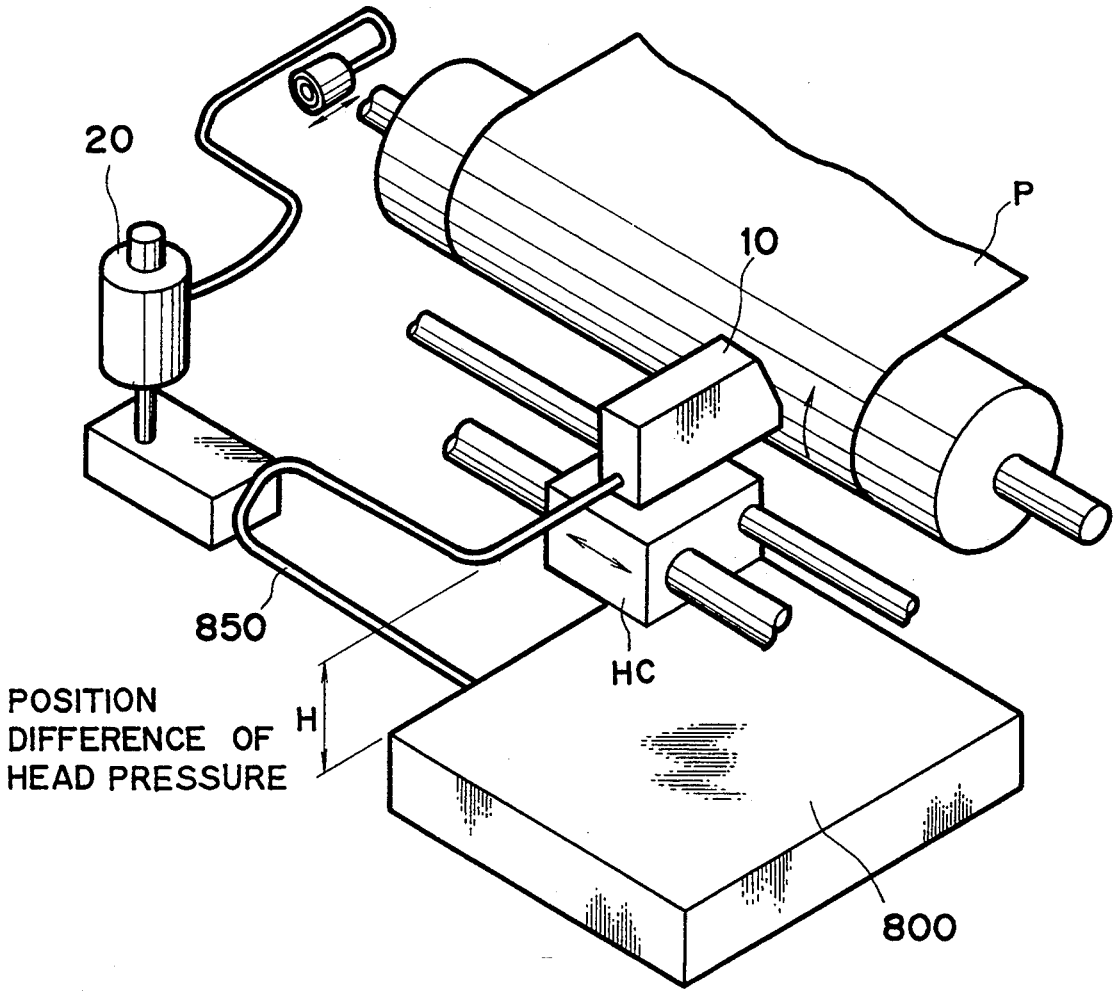
FIG. 9 is a schematic view of an ink jet recording apparatus employing a conventional ink cassette.

FIG. 8 illustrates a fourth embodiment of the present invention, wherein the ink jet cartridge is composed of a recording head and a large-capacity ink tank of about 100 cc, in mutually separate configuration. In FIG. 8, there are shown a slit bladder 1100, a slit 1110, a mounting 1120, a rib 1130 for defining the direction of deformation, a replacement ink tank 1150, a first ink tank 1180, a second ink tank 1190, a vibration preventing wall 1200, a guide member 1230 at the ink tank side, a guide member 1240 at the recording head side, an ink path 1280, a recording head 1300, and a connecting part 1320 between the recording head and the ink tank.

In the present embodiment, if the ink jet cartridge of a large capacity is positioned vertically, the water head of ink in the ink tank becomes as large as $+100$ mm, whereby the negative pressure range permissible to the slit bladder becomes narrow and is unable to satisfy the required performance. Consequently the printer is designed with the horizontal position, in which the ink in the ink tank has a smaller water head. FIG. 8 shows a large-capacity ink jet cartridge for horizontal positioning, with a slit bladder in the illustrated position. In this case the negative pressure of the slit bladder can be designed in consideration only of the water head of ink in the ink tank.

More specifically, the pressure of ink in the ink tank, applied to the nozzles of the recording head in the horizontal position is $+40$ mm head, as indicated by G. In order to prevent ink leakage from the nozzles of the recording head, the pressure applied to said nozzles, corresponding to the difference between the water head of ink and the negative pressure of the slit bladder, is preferably a negative pressure in the order of $-10$ mm. Consequently the minimum value of the negative pressure of the slit bladder is about $-50$ mm head, and the maximum value is preferably about $-150$ mm in consideration of the printing pressure range of the recording head, so as not to cause deterioration in the print quality with the decrease of the water head of ink in the ink tank, before the ink runs out in the tank. Thus the negative pressure of the silt bladder can be designed to satisfy a range of $-100\pm50$ mm head, by suitable selection of the elastic modulus, curvature and thickness.

In case of the large-capacity ink tank, the slit bladder itself need not be made very small since the ink tank itself is large. Thus the tolerances for the rubber hardness and the thickness can be made larger, by selecting a large curvature.

Figure 11:
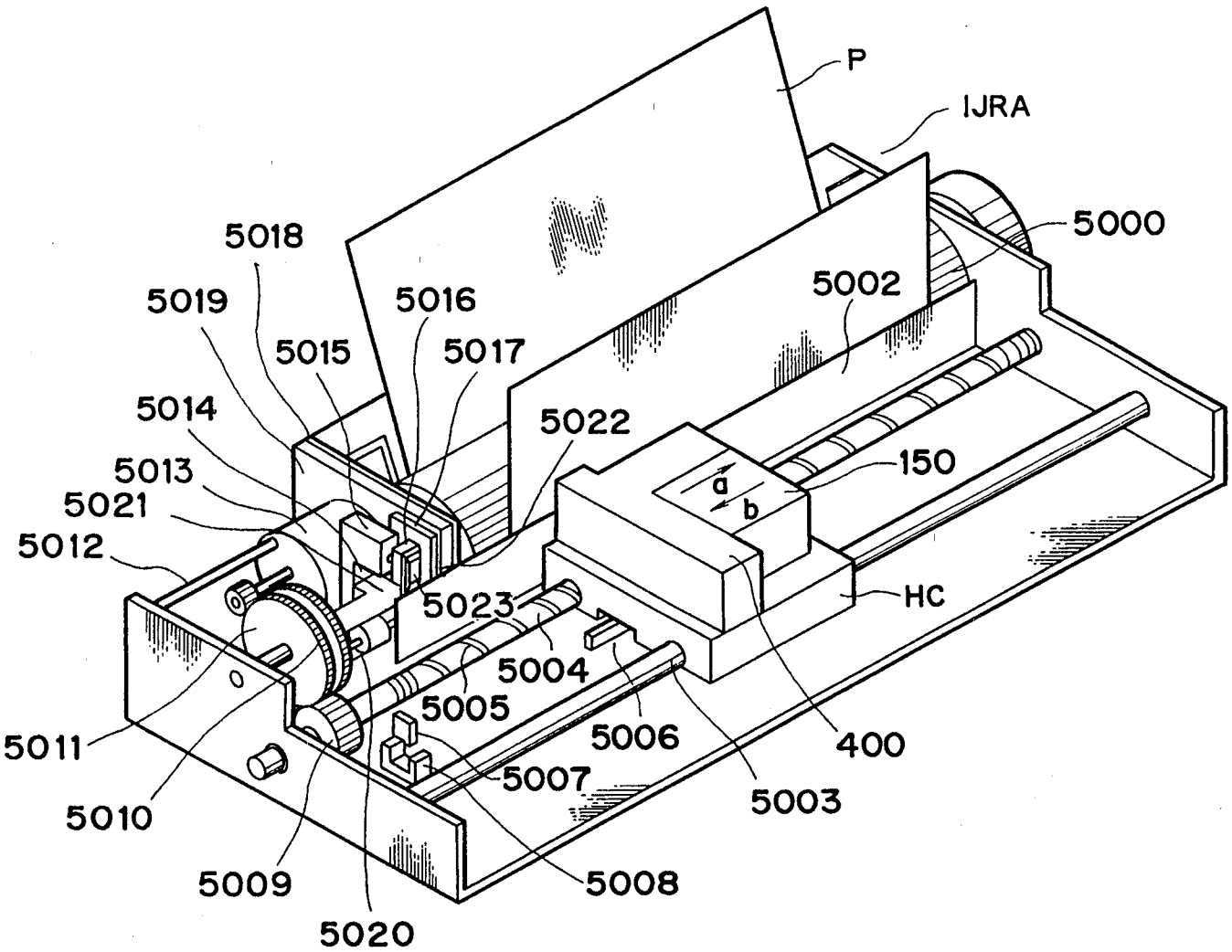
FIG. 11 its a view showing the recording state with a horizonally placed printer in which mounted is an ink jet cartridge with a replaceable small-capacity ink tank incorporating a slit bladder, constituting the second embodiment of the present invention.
Figure 12:
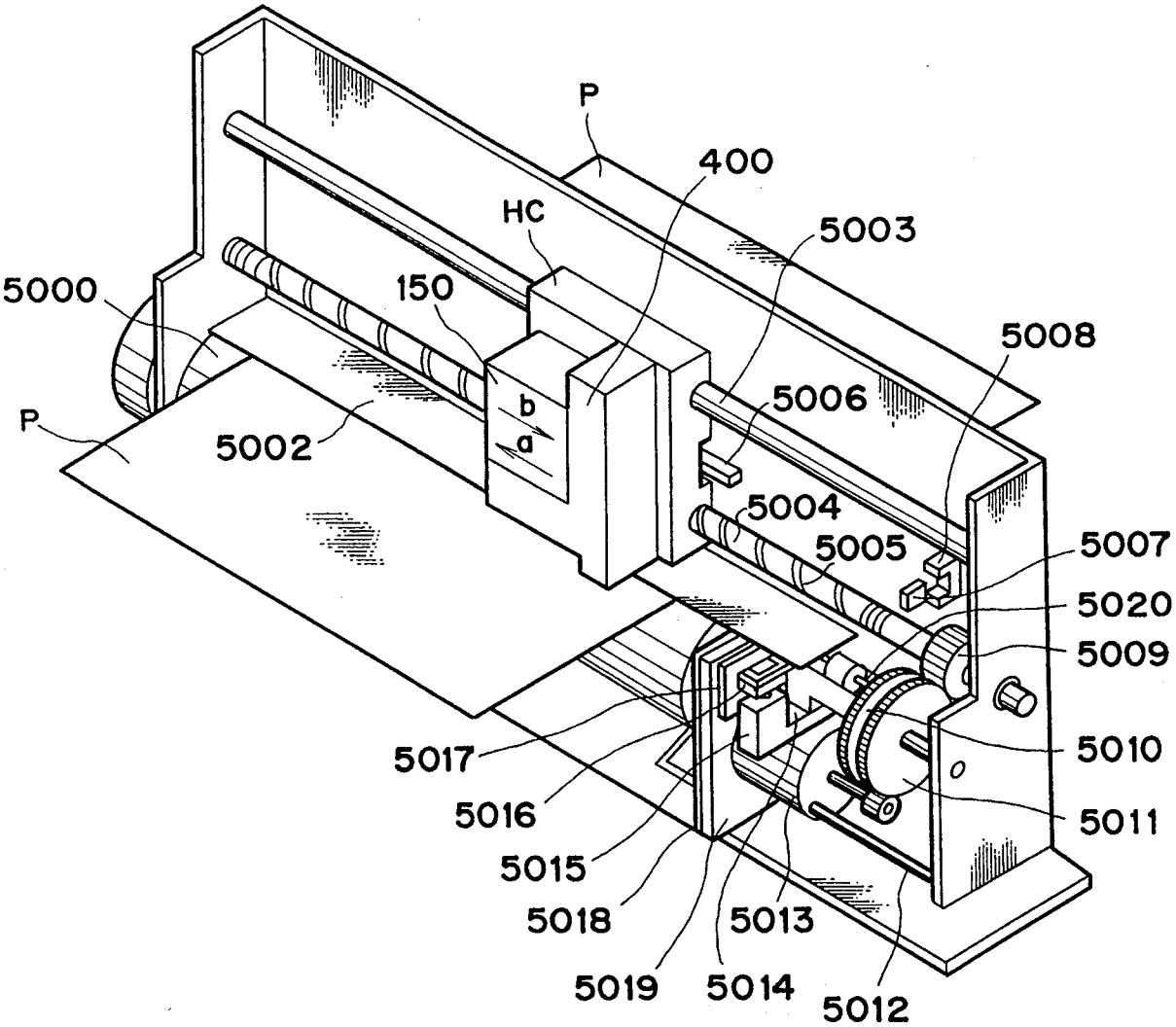
FIG. 12 is a view showing the recording state with a vertically placed printer in which mounted is an ink jet cartridge with a replaceable small capacity ink tank incorporating a slit bladder, constituting the second embodiment of the present invention.

FIGS. 11 and 12 show different printing positions of a printer loaded with an ink jet cartridge employing a small-capacity replacement ink tank. Such printer, with an ink jet cartridge employing a small-capacity ink tank, may be used in the vertical and horizontal positions for printing operation. In FIG. 11, the printer is horizontally positioned so that the ink jet cartridge is placed horizontally. In FIG. 12, the printer is vertically positioned so that the ink jet cartridge is placed vertically.

Figure 13:
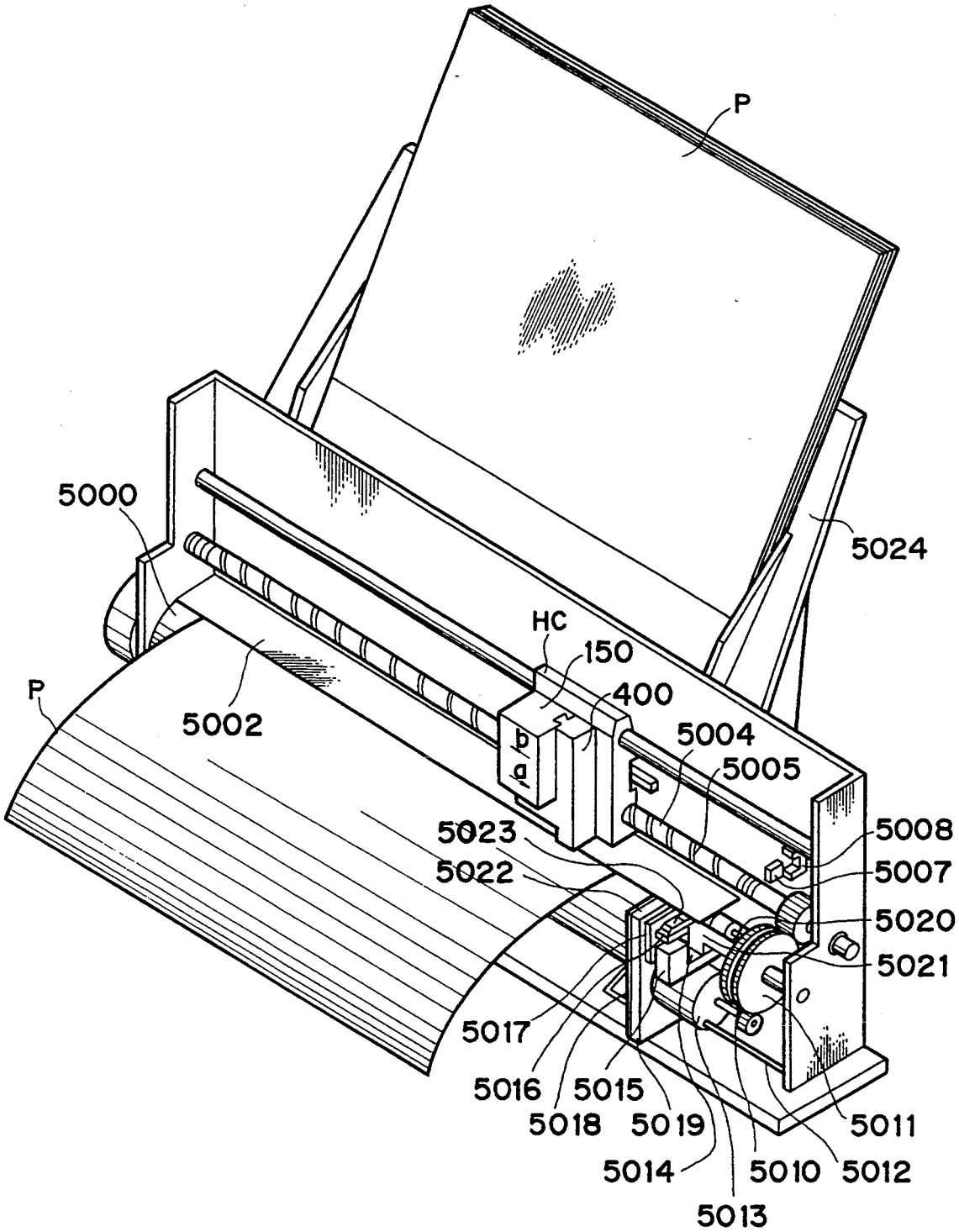
FIG. 13 is a view showing a vertically positioned printer which can be vertically or horizontally placed and is provided with an ink jet cartridge with a replaceable medium-capacity ink tank for vertical positioning, incorporating a slit bladder and constituting the third embodiment of the present invention.
Figure 14:
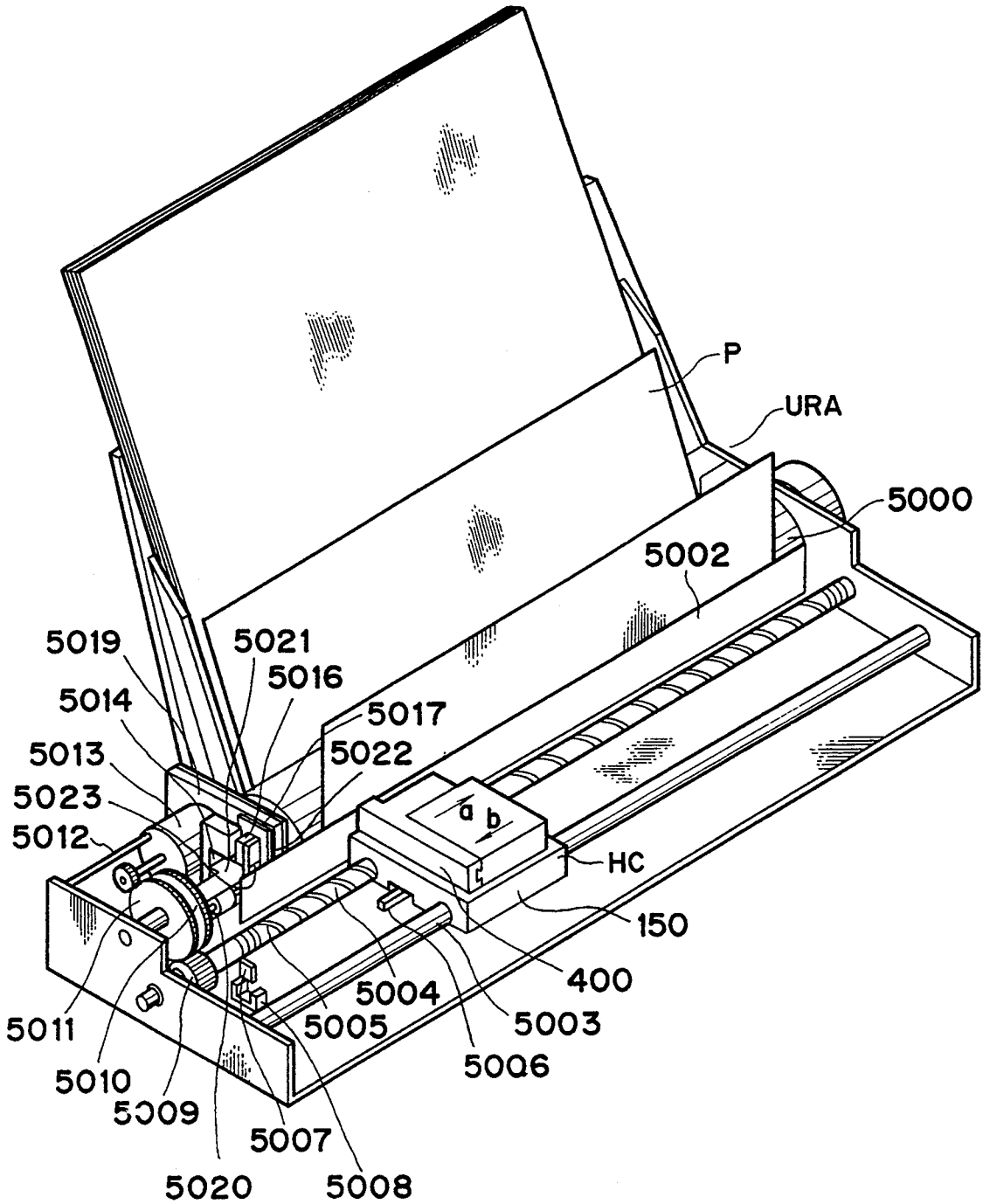
FIG. 14 is a view of a printer for horizontal positioning, provided with an ink jet cartridge with a replaceable medium-capacity ink tank incorporating a slit bladder, constituting the third embodiment of the present invention.

FIGS. 13 and 14 show printers loaded with an ink jet cartridge employing a medium-capacity replacement ink tank. The printer shown in FIG. 13 can be vertically or horizontally positioned, and is provided with a vertically positioned ink jet cartridge employing an ink tank for vertical positioning, but can also effect printing operation in the horizontal positioning. The printer shown in FIG. 14 is designed for horizontal positioning and is provided with a horizontally positioned ink jet cartridge employing a replacement ink tank for horizontal positioning. As shown in these drawings, by constructing the ink tank separably for a common recording head, and providing the replacement ink tank with a slit bladder with optical negative pressure, the ink jet cartridge with the medium-capacity replacement ink tank can be used in both the vertical and horizontal positions by the use of an ink tank for vertical positioning, and can be used more inexpensively by the use of a replacement ink tank for horizontal positioning.

Figure 15:
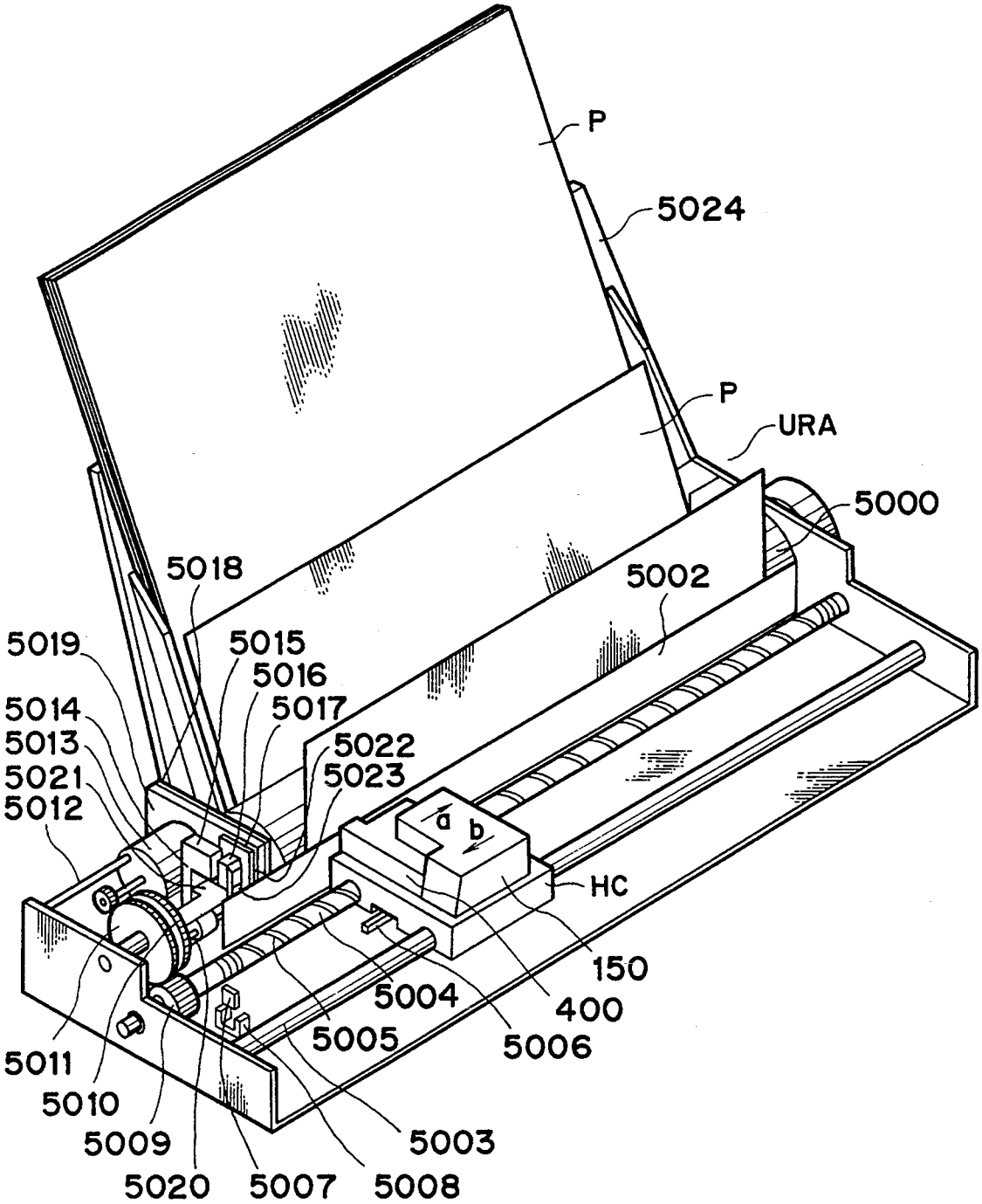
FIG. 15 is a view of a printer for horizontal positioning, provided with an ink jet cartridge with a replaceable large- capacity ink tank incorporating a slit bladder, constituting the fourth embodiment of the present invention.

FIG. 15 shows an ink jet recording apparatus loaded with an ink jet cartridge employing a large-capacity replacement ink tank. A large-capacity ink jet cartridge, if positioned vertically, will show an increased water head of ink in the ink tank, thereby the negative pressure range permissible in the slit bladder becomes narrower and cannot satisfy the required performance. Consequently the large-capacity ink tank is designed for horizontal positioning. In FIG. 15, therefore, the ink jet cartridge employing a large-capacity ink tank is positioned horizontally.

In FIGS. 11 to 15, a carriage HC is provided with a pin engaging with a spiral groove 5005 of a lead screw 5004 which is rotated in forward and reverse directions by a motor 5013 through driving gears 5011, 5009, and is reciprocally moved in directions indicated by arrows a, b. The carriage HC supports a recording head 5025, and an ink cartridge 5026. A paper pressure plate 5002 presses the paper to a platen 5000 along the moving direction of the carriage. An automatic sheet feeder 5027 is normally provided on ink jet recording apparatus with an ink jet cartridge of medium or large capacity, as the number of sheets to be printed is large. A photocoupler 5007, 5008 serves as home position detection means for detecting the presence of a lever 5006 of the carriage and accordingly switching the rotating direction of the motor 5013. There are also provided a member 5016 for supporting a cap member 5022 for capping the front face of the recording head, and suction means 5015 for sucking the interior of said cap, for effecting the recovery of the recording head by suction through an aperture 5023 in said cap. A cleaning blade 5017 and a member 5019 for moving said blade front and back, are supported by a support plate 5018. The blade is not limited to such form, and already known cleaning blades can naturally be used for this purpose. A lever 5012, for starting the suction for the recovery of the recording head, is displaced by the movement of a cam 5020 engaging with the carriage, and receives the driving force of the motor through known transmission means such as a clutch.

These capping, cleaning and sucking operations are executed at respective positions by the function of the lead screw 5005 when the carriage HC is placed at the home position area, but these operations may also be conducted at suitable timings in the known manner.

Among various ink jet recording methods, the present invention brings about a particular effect when applied to a recording head or a recording apparatus equipped with means for generating thermal energy as the energy utilized for ink discharge and inducing a state change in ink by said thermal energy.

The principle and representative configuration of said system are disclosed, for example, in U.S. Pat. Nos. 4,723,129 and 4,740,796. This system is applicable to so-called on-demand recording or continuous recording, but is particularly effective in the on-demand recording because, in response to the application of at least a drive signal representing the recording information to an electrothermal converter element positioned corresponding to a liquid channel or a sheet containing liquid (ink) therein, said element generates thermal energy capable of causing a rapid temperature increase exceeding the nucleate boiling point, thereby inducing film boiling on a heat action surface of the recording head and thus forming a bubble in said liquid (ink) in one-to-one correspondence with said drive signal. Said liquid (ink) is discharged through a discharge opening by the growth and contraction of said bubble, thereby forming at least a liquid droplet. Said drive signal is preferably formed as a pulse, as it realizes instantaneous growth and contraction of the bubble, thereby attaining highly responsive discharge of the liquid (ink). Such pulse-shaped drive signal is preferably that disclosed in U.S. Pat. Nos. 4,463,359 and 4,345,262. Also the conditions described in U.S. Pat. No. 4,313,124 relative to the temperature increase rate of said heat action surface allows to obtain further improved recording.

The configuration of the recording head is given by the combinations of the liquid discharge openings, liquid channels and electro-thermal converter elements with linear or rectangular liquid channels, disclosed in the above-mentioned patents, but a configuration disclosed in U.S. Pat. No. 4,558,333 in which the heat action part is positioned in a flexed area, and a configuration disclosed in U.S. Pat. No. 4,559,600 also belong to the present invention. Furthermore the present invention is effective in a structure disclosed in Japanese Patent Laid-Open Application No. 59-123670, having a slit common to plural electro-thermal converter elements as a discharge opening therefor, or in a structure disclosed in Japanese Patent Laid-Open Application No. 59-138461, having an aperture for absorbing the pressure wave of thermal energy, in correspondence with each discharge opening.

Also the recording apparatus is preferably provided with the emission recovery means and other auxiliary means for the recording head, since the effects of the recording head of the present invention can be stabilized further. Examples of such means for recording head include capping means, cleaning means, pressurizing or suction means, preliminary heating means composed of electro-thermal converter element and/or another heating device, and means for effecting an idle ink discharge independent from the recording operation, all of which are effective for achieving stable recording operation.

Furthermore, the present invention is not limited to a recording mode for recording a single main color such as black, but is extremely effective also with a recording head for recording plural different colors or full color by color mixing, wherein the recording head is either integrally constructed or is composed of plural units.

As explained in the foregoing, it is rendered possible to design a suitable negative pressure for the ink tank according to the size of capacity thereof and the positioning of the recording head at printing, by constructing the recording head and the ink tank in mutually separable manner, and providing the interior of said ink tank with a partition wall composed of an elastic material, with a slit which is opened by the deformation of said partition wall under a predetermined pressure difference and is closed when said pressure difference is eliminated.

The negative pressure range permissible to the slit bladder varies depending on the ink tank capacity or the position of the recording head, but the designing of negative pressure for each ink tank allows to widen such permissible negative pressure range, thereby broadening the tolerance for the thickness of the slit bladder and reducing the cost thereof. It is also made possible to combine the ink tanks of difference capacities with same recording head. Therefore, in an ink jet recording apparatus for personal use, there can be employed an ink jet cartridge with a small-capacity ink tank whereby the printing is possible in different positions. In the ink jet recording apparatus for office-personal use, there can be employed an ink jet cartridge with a medium-capacity ink tank, and the apparatus can effect printing operation both in the vertical and horizontal positions by loading the recording head with an ink tank for vertical position, or can provide the ink tank more inexpensively by using an ink tank for horizontal position. In the ink jet recording apparatus for office use, there can be employed an ink jet cartridge with a large-capacity ink tank, in combination with the recording apparatus limited for horizontal positioning. In this manner a single recording head can be employed in different ink jet recording apparatus from personal use to office use.

Besides, the recording head can be used multiple times by the replacement of the ink tank, so that the running cost can be reduced. Also the ink tank of medium or large capacity of the present invention does not require the space for installation in the main body of the apparatus and the space for the connecting tube, in comparison with the conventional fixed ink tank, thereby allowing to compactize the recording apparatus. Also the printing speed can be increased because of absence of the connecting tube between the recording head and the ink cassette.

What is claimed is:

1. A liquid discharge cartridge having liquid discharge means and a liquid container for containing liquid to be supplied to said liquid discharge means, said liquid container comprising:

a liquid storing section for storing liquid;

a liquid introducing section connected to said liquid discharge means to introduce liquid in said liquid storing section to said liquid discharge means;

an elastic separation member separating said liquid storing section from said liquid introducing section and having a cutout, wherein said separation member deforms to open said cutout and allow liquid to flow from said liquid storing section to said liquid introducing section in the presence of a predetermined pressure difference from said liquid storing section to said liquid introducing section and to close said cutout and limit flow of liquid in the presence of a pressure difference smaller than said predetermined pressure difference; and elastic closing means spaced from said cutout and having a predetermined elasticity to be deformable in response to pressure variations in said liquid introducing section, wherein said closing means deforms to close said cutout in the presence of a predetermined pressure drop from said liquid introducing section to said liquid storing section.

2. A liquid discharge cartridge according to claim 1, wherein said closing means is spaced from said separation member a distance of 0.5 mm when said closing means is not deformed.

3. A liquid discharge cartridge according to claim 1, wherein said predetermined pressure drop is preferably between 0 and 30 mm of water.

4. A liquid discharge cartridge according to claim 1, wherein said separation member has a dome shape and said cutout is at a top of said dome.

5. A liquid discharge cartridge according to claim 4, wherein said separation member is disposed on an elliptical fitting base and said cutout comprises a slit in a direction across a longer axis of said ellipse.

6. A liquid discharge cartridge according to claim 1, wherein said separation member provides liquid to said liquid discharge means at a pressure difference of +30 mm to −200 mm of water, and preferably at a pressure of 0 mm to −200 mm of water.

7. A liquid discharge cartridge according to claim 1, wherein said separation member provides liquid to said liquid discharge means at a pressure difference of +30 mm to −200 mm water, and preferably at a pressure of 0 mm to −200 mm of water, regardless of the orientation of said liquid container.

8. A liquid discharge cartridge according to claim 1, wherein said liquid discharge means discharges liquid using thermal energy and has an electrothermal converting element.

9. An ink jet recording apparatus for discharging ink, said recording apparatus comprising:

an ink jet recording head;

an ink tank for storing ink to be supplied to said ink jet recording head; and a supporting member for removably supporting said ink jet recording head and said ink tank, wherein said ink tank comprises:

an ink storing section for storing ink, an ink introducing section connected to said ink jet recording head to introduce ink in said ink tank to said ink jet recording head, an elastic separation member separating said ink storing section from said ink introducing section and having a cutout, wherein said separation member deforms to open said cutout and allow ink to flow from said ink storing section to said ink introducing section in the presence of a predetermined pressure difference from said ink storing section to said ink introducing section and to close said cutout and limit flow of ink in the presence of a pressure difference smaller than said predetermined pressure difference, and elastic closing means spaced from said cutout and having a predetermined elasticity to be deformable in response to pressure variations in said ink introducing section, wherein said closing means deforms to close to said cutout in the presence of a predetermined pressure drop from said ink introducing section to said ink storing section.

10. An apparatus according to claim 9, wherein said closing means is spaced from said separation member a distance of 0.5 when said closing means is not deformed.

11. An apparatus according to claim 9, wherein said predetermined pressure drop is preferably between 0 and 30 mm of water.

12. An apparatus according to claim 9, wherein said separation member has a dome shape and said cutout is at a top of said dome.

13. An apparatus according to claim 12, wherein said separation member is disposed on an elliptical fitting base and said cutout comprises a slit in a direction across a longer axis of said ellipse.

14. An apparatus according to claim 9, wherein said separation member provides ink to said ink jet recording head at a pressure of +30 mm to −200 mm of water, and preferably at a pressure of 0 mm to −200 mm of water.

15. An apparatus according to claim 9, wherein said separation member provides ink to said ink jet recording head at a pressure of +30 mm to −200 mm of water, and preferably at a pressure of 0 mm to −200 mm of water, regardless of the orientation of said ink tank.

16. An apparatus according to claim 9, wherein said ink jet recording head discharges ink using thermal energy and has an electrothermal converting element.

17. An ink tank for storing ink to be supplied to a recording head, said ink tank comprising:

an ink storing section for storing ink;

an ink introducing section disposed for connection to said recording head to introduce ink in said ink storing section to said recording head;

an elastic separation member separating said ink storing section from said ink introducing section and having a cutout, wherein said separation member deforms to open said cutout and allow ink to flow from said ink storing section to said ink introducing section in the presence of a predetermined pressure difference from said ink storing section to said ink introducing section and to close said cutout and limit flow of ink in the presence of a pressure difference smaller than said predetermined pressure difference; and elastic closing means spaced from said cutout and having a predetermined elasticity to be deformably in response to pressure variations in said ink introducing section, wherein said closing means deforms to close said cutout in the presence of a predetermined pressure drop from said ink introducing section to said ink storing section.

18. An ink tank according to claim 17, wherein said closing means is spaced from said separation member a distance of 0.5 mm when said closing means is not deformed.

19. An ink tank according to claim 17, wherein said predetermined pressure drop is preferably between 0 and 30 mm of water.

20. An ink tank according to claim 17, wherein said separation member has a dome shape and said cutout is at a top of said dome.

21. An ink tank according to claim 20, wherein said separation member is disposed on an elliptical fitting base and said cutout comprises a slit in a direction across a longer axis of said ellipse.

22. An ink tank according to claim 17, wherein said separation member provides ink to said recording head at a pressure difference of +30 mm to −200 mm of water, and preferably at a pressure of 0 mm to −200 mm of water.

23. An ink tank according to claim 17, wherein said separation member provides ink to said recording head at a pressure difference of +30 mm to −200 mm water, and preferably at a pressure of 0 mm to −200 mm of water, regardless of the orientation of said ink tank.

* * * * *

UNITED STATES PATENT AND TRADEMARK OFFICE

CERTIFICATE OF CORRECTION

PATENT NO. : 5,365,260

DATED : November 15, 1994

INVENTOR(S) : MASASHI KITANI, ET AL.

It is certified that error appears in the above-indentified patent and that said Letters Patent is hereby corrected as shown below:

COLUMN 3

Line 5, "but" should be deleted.
Line 40, "supply ink," should read --supplying ink,--.

COLUMN 4

Line 38, "mode" should read --mode of--.

COLUMN 5

Line 41, "its" should read --is--.

COLUMN 12

Line 9, "silt" should read --slit--.

COLUMN 14

Line 40, "difference" should read --different--.
Line 41, "with" should read --with the--.

COLUMN 16

Line 19, "close to" should read --close--.
Line 24, "0.5" should read --0.5 mm--.

UNITED STATES PATENT AND TRADEMARK OFFICE

CERTIFICATE OF CORRECTION

PATENT NO. : 5,365,260

DATED : November 15, 1994

INVENTOR(S) : MASASHI KITANI, ET AL.

It is certified that error appears in the above-indentified patent and that said Letters Patent is hereby corrected as shown below:

COLUMN 16

Line 66, "deformably" should read --deformable--.

Signed and Sealed this

Fourth Day of April, 1995

*Attest:*

*Attesting Officer*

BRUCE LEHMAN

*Commissioner of Patents and Trademarks*